US007282873B2

(12) United States Patent
Abali et al.

(10) Patent No.: US 7,282,873 B2
(45) Date of Patent: Oct. 16, 2007

(54) MUTUAL ACTIVE CANCELLATION OF FAN NOISE AND VIBRATION

(75) Inventors: Bulent Abali, Tenafly, NJ (US); D. Scott Guthridge, New York, NY (US); Richard E. Harper, Chapel Hill, NC (US); Peter A. Manson, Cary, NC (US); Harry B. Marr, Jr., Atlanta, GA (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 410 days.

(21) Appl. No.: 10/989,866

(22) Filed: Nov. 16, 2004

(65) Prior Publication Data

US 2006/0103334 A1 May 18, 2006

(51) Int. Cl.
*H02P 5/00* (2006.01)

(52) U.S. Cl. ..... 318/41; 318/49; 318/268; 417/2; 417/42

(58) Field of Classification Search ..... 318/41, 318/49, 55, 59, 85, 268; 417/2, 42
See application file for complete search history.

(56) References Cited

U.S. PATENT DOCUMENTS 5,692,054 A 11/1997 Parrella et al.
5,832,095 A 11/1998 Daniels
5,995,632 A 11/1999 Okada
6,188,770 B1 2/2001 Okada
6,257,832 B1 * 7/2001 Lyszkowski et al. ..... 417/2
6,381,406 B1 4/2002 Smith et al.
6,400,113 B1 6/2002 Garcia et al.
6,422,303 B1 7/2002 Ishida et al.
6,428,282 B1 * 8/2002 Langley ..... 417/2
2002/0003409 A1 * 1/2002 Brown et al. ..... 318/254
2005/0237717 A1 * 10/2005 Babb et al. ..... 361/697

* cited by examiner

*Primary Examiner*—Rina Duda
(74) *Attorney, Agent, or Firm*—Gibb & Rahman, LLC

(57) ABSTRACT

A multi-fan apparatus and method incorporates mutual active cancellation of fan noise and/or vibrations. The multi-fan apparatus includes two or more fans circuits, each comprising a fan, a fan speed controller and a separate tachometer, and a fan phase controller. The phase controller is connected to at least one fan speed controller and to each tachometer. Each fan's speed is independently and dynamically maintained at the same set speed by the fan speed controllers using an independent control loops. A noise and/or vibration cancellation phase difference between fans is determined in order to achieve destructive interference of pressure waves and, thus, noise and/or vibration reduction, in pre-determined region of a system incorporating the multi-fan apparatus. The phase controller establishes and maintains this cancellation phase difference between the fans based upon feedback from the tachometers.

16 Claims, 10 Drawing Sheets

MUTUAL ACTIVE CANCELLATION OF FAN NOISE AND VIBRATION

BACKGROUND OF THE INVENTION

1. Field of the Invention

The present invention relates to mutual active noise and vibration cancellation and in particular to a multi-fan apparatus incorporating at least two fans which mutually cancel each other's noise and/or vibrations.

2. Description of the Related Art

Many electronic systems, such as computer systems, require active cooling in order to maintain component temperatures at acceptable levels. Active cooling is usually accomplished by air moving devices, such as blowers and fans, with rotating components (e.g., blades, rotors, and other rotating machinery). All such air cooling devices shall be referred to herein as fans. Modern computer systems generate so much heat that these fans must be very powerful, and therefore generate a large amount of noise and vibration. The amount of noise that can be produced by an electronic system is limited by safety and regulatory agencies in this and other countries. Fan noise may thus impede sales into countries and environments with stringent noise standards. Since noise production is directly related to a fan's air cooling capacity, these noise standards also effectively impose a constraint on the processing power that can be installed into a computer system.

Today several techniques are used to reduce fan noise and vibration. Fans are isolation-mounted, baffled, and sculpted to reduce conducted and radiated noise. Fan blades may be constructed out of soft materials that limit noise radiation. However, these techniques are reaching the limits of their effectiveness, and are already commonly in use. In some environments active noise cancellation is used, wherein speakers, microphones, and a feedback circuit launch an inverse sound wave that destructively interferes with the original unwanted noise. This technique is currently considered too costly for inclusion into modern computer systems.

SUMMARY OF THE INVENTION

An embodiment of the present invention is a multi-fan apparatus incorporating mutual active wave cancellation to reduce noise and/or vibration caused by the fans. The multi-fan apparatus comprises multiple fan circuits (e.g., first and second fan circuits). Each fan circuit comprises a fan, a tachometer and a fan speed controller. The tachometers are adapted to detect and signal a fan's phase of rotation. Each fan speed controller can be adapted to determine a fan's speed, based upon tachometer phase of rotation signals and to independently and dynamically maintain the fan at a set speed. A fan speed determiner connected to each of the fan speed controllers can input a same set fan speed to each of the fan speed controllers, such that the fans may be synchronized to the same speed. The multi-fan apparatus further comprises a fan phase controller connected to at least one of the fan speed controllers and to each tachometer. The fan phase controller can be adapted to separate the phases of rotation between fans to establish a cancellation phase of rotation difference which serves to reduce noise and/or vibration.

More particularly, the fan phase controller can comprise a processing device. The processing device can be adapted to read phase of rotation signals emanating from the tachometers. The processing device can be adapted to determine a current phase of rotation difference between the fans based upon tachometer signals and to compare the cancellation phase difference with the current phase difference. The processing device can further be adapted to determine fan speed by monitoring the tachometer signals. The processing device can also be adapted to calculate a short term fan speed variation for at least one of the fans that is required to separate their phases of rotation to achieve the cancellation phase difference. Once the short term fan speed variation calculated, the controller can signal the speed variation to a fan speed controller.

In addition, the fan phase controller can comprise a memory device for storing the cancellation phase difference. The cancellation phase difference can be pre-determined, with or without sound or vibration feedback, and stored in the memory device. Specifically, a cancellation phase difference can be pre-determined for canceling noise and/or vibration in any given location, not limited to a fan duct outlet, within a system incorporating the multi-fan apparatus of the present invention. The pre-calculated phase difference can then be programmed into the memory device of the fan phase controller.

The cancellation phase difference can also be dynamically determined by a cancellation phase difference determiner based upon feedback measurements from sound and/or vibration sensors. The cancellation phase difference required to reduce noise and/or vibration in a localized region of a system incorporating the fan apparatus of the present invention can be variable depending upon multiple factors, including but not limited to, the following: the physical arrangement of the fans within the system; with the system the location of the region, where the cancellation is desired, relative to the location of the fans; the speed of propagation of the pressure waves; the relative spacing between fan outlets in the system, and the number of fan blades on each fan.

Another embodiment of the present invention is a fan noise and vibration cancellation method. According to the fan noise and vibration cancellation method, a cancellation phase difference between at least two fans to provide noise and/or vibration cancellation is determined. The fans are independently maintained at the same set speed. Once the same set speed is established, the phase of rotation of at least one of the fans is adjusted relative to another of the fans to establish and maintain the cancellation phase difference.

More particularly, a cancellation phase difference between at least two fans in a system is determined so as to cause destructive interference to sound and/or vibration pressure waves in a localized region, where the cancellation is desired, within the system. This cancellation phase difference may be pre-determined with or without the use of sound or vibration sensors. It may also be dynamically determined. Specifically, within a system incorporating the fan apparatus, sound and/or vibration measurements are taken in any localized region, not limited to the air duct outlets, where noise and/or vibration cancellation is desired. And the cancellation phase difference is dynamically changed based upon those measurements. In order to adjust the phase of rotation of at least one of the fans relative to the phase of rotation of another, the fan phase of rotation signals emanating from fan tachometers connected to each of the fans are read and the tachometer readings are used to determine a the speed of the fans and a current phase of rotation difference between the fans. The current phase difference is compared to the cancellation phase difference. Then, a short term fan speed variation is calculated. This speed variation is the adjusted speed required for at least one of the fans in order to separate the phases of rotation between the fans to establish the cancellation phase difference. The short term fan speed variation is then signaled to a fan speed controller and the fan speed controller adjusts the speed of the fan, accordingly.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

The invention will be better understood from the following detailed description with reference to the drawings, in which.

DETAILED DESCRIPTION OF PREFERRED EMBODIMENTS OF THE INVENTION

Figure 1A:
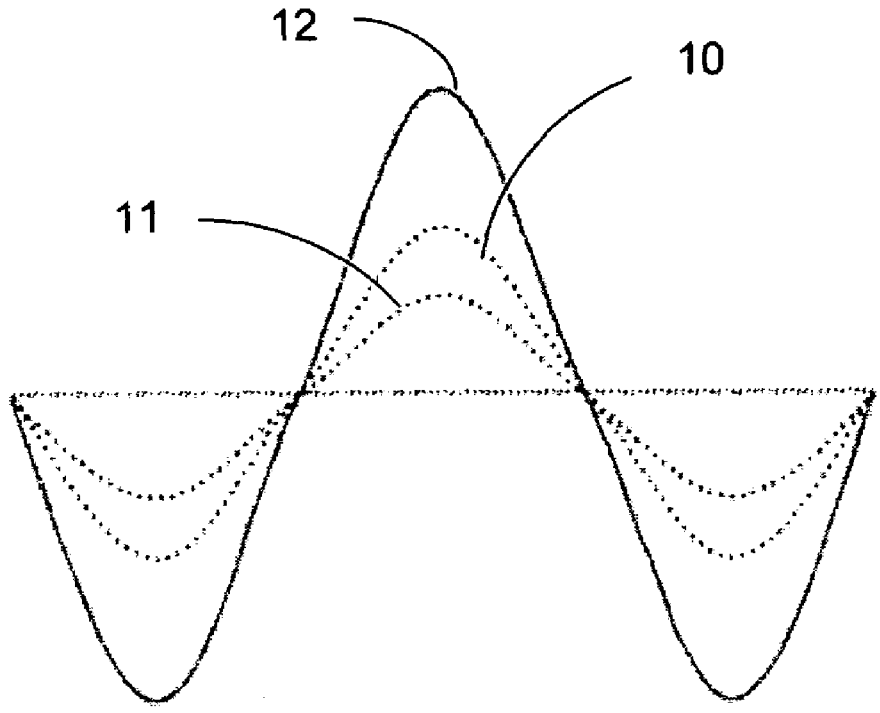
FIGS. 1A and 1B are schematic graphs illustrating constructive and destructive wave interference, respectively.
Figure 1B:
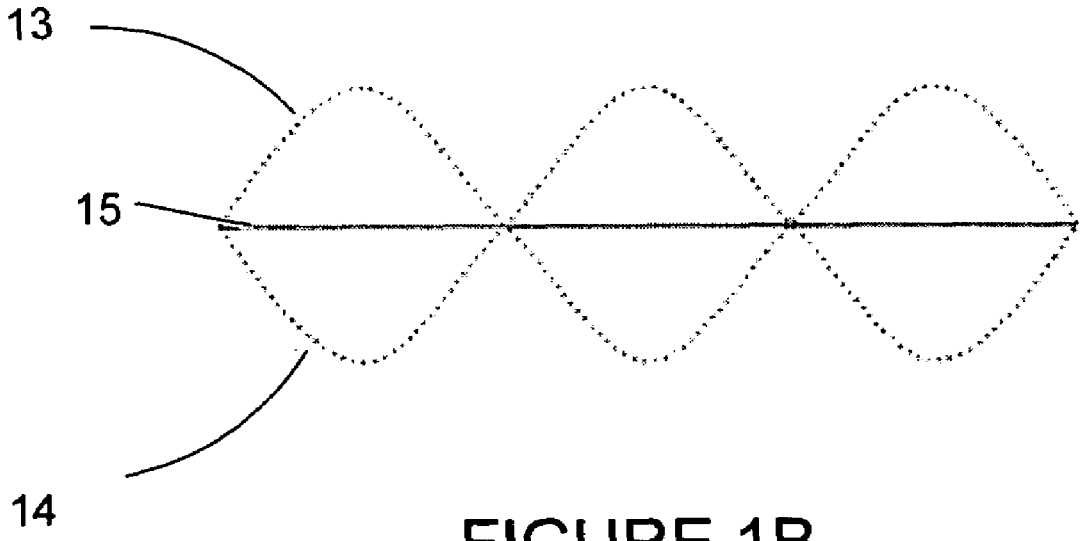

The present invention is a multi-fan apparatus 1 and a method that incorporates at least two fans which mutually cancel each other's noise and/or vibrations. The idea that air moving devices such as fans or blowers (hereinafter referred to as fans) can mutually cancel each other's noise and/or vibrations is based upon the principle of destructive interference. Referring to FIG. 1, when two or more waves (e.g., sound or vibration pressure waves) simultaneously and independently travel through the same medium at the same time, their effects are super-positioned. The result of that superposition is called interference. There are two types of interference: constructive (FIG. 1A) and destructive (FIG. 1B). Constructive interference occurs when the wave amplitudes reinforce each other 10, 11, building a wave of even greater amplitude 12. Destructive interference occurs when the wave amplitudes oppose each other 13, 14, resulting in waves of reduced amplitude 15.

For example, a significant source of unwanted fan noise is the sound of the fan blades passing a given point in space. This is known as the Blade Passing Frequency, or BPF. The BPF of an exemplary fan produces a 500 Hz tone. In order to cancel out a 500 Hz tone, one must produce an anti-noise such that a 500 Hz tone is produced at exactly the same amplitude as the original tone. However, at the intersection of the noise and the anti-noise, the anti-500 Hz tone is 180 degrees out of phase with the original 500 Hz tone. Thus, the pressure waves from the noise and anti-noise are equal and opposite in nature and cancel out to a zero amplitude wave, at least at that synchronized frequency (fan speed). Using this method, an optimal wave cancellation phase difference may be calculated to provide destructive interference to reduce particular noises or vibrations. For example, a cancellation phase difference may be calculated to provide destructive interference to reduce a particularly annoying high-pitched, modulated whine caused by fan blade passing frequency. In another example, an optimal wave cancellation phase difference may be calculated for reducing a significant vibration pressure wave caused by the fans. If one fan vibrates the chassis in one direction, then the other fan's relative vibration pressure wave phase can be controlled so as cancel or reduce the vibration.

Figure 2A:
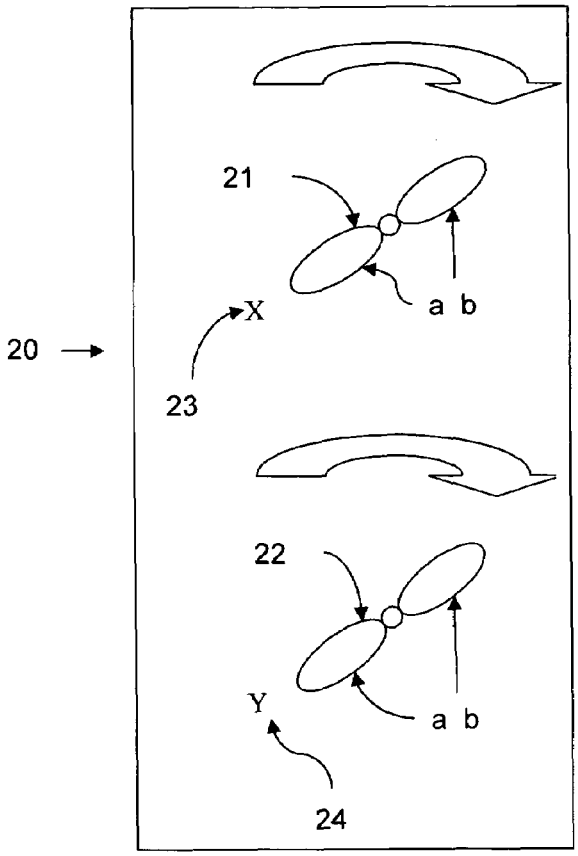
FIG. 2*a* is a schematic drawing illustrating a two-fan apparatus with uncontrolled fan rotation phase and FIG. 2*b* is a schematic drawing illustrating constructive interference of pressure waves from the apparatus of FIG. 2*a;*
Figure 2B:
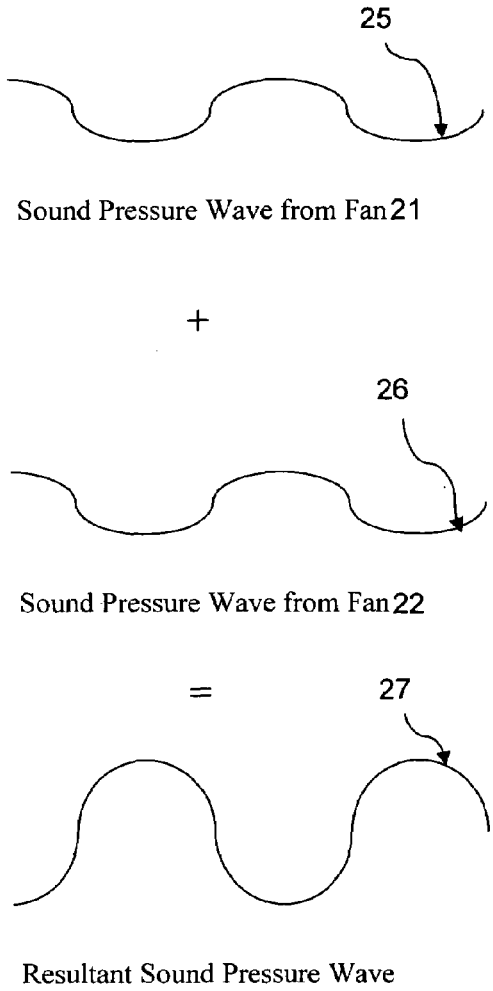

Referring to FIGS. 2*a* and 2*b* in combination, constructive interference is illustrated. The constructive interference can be due to uncontrolled rotation phase of pressures waves produced by the two fans 21 and 22 of a two-fan apparatus 20, where each exemplary fan 21, 22 has two fan blades 21*a, b* and 22*a, b*, respectively, rotating clockwise. As each fan blade 21*a, b* and 22*a, b* passes a given point (e.g., point X 23 for fan 21 and point Y 24 for fan 22) a sound pressure wave (acoustic wave) is generated. This sound pressure wave is perceived as acoustic noise. Each fan 21, 22 generates its own sound pressure wave 25 and 26, respectively, and the resultant sound pressure wave 27 is the sum of the two waves 25 and 26, added according to the principle of wave superposition. If the different times, when the blades 21*a, b* and 22*a, b* of the two fans 21 and 22 pass the points X 23 and Y 24, are uncontrolled or the blades 21*a, b* and 22*a, b* pass these points at exactly the same time (as illustrated in FIG. 2*a*), then the acoustic waves 25 and 26 add constructively (i.e. constructive interference), and the acoustic noise is increased.

Figure 3A:
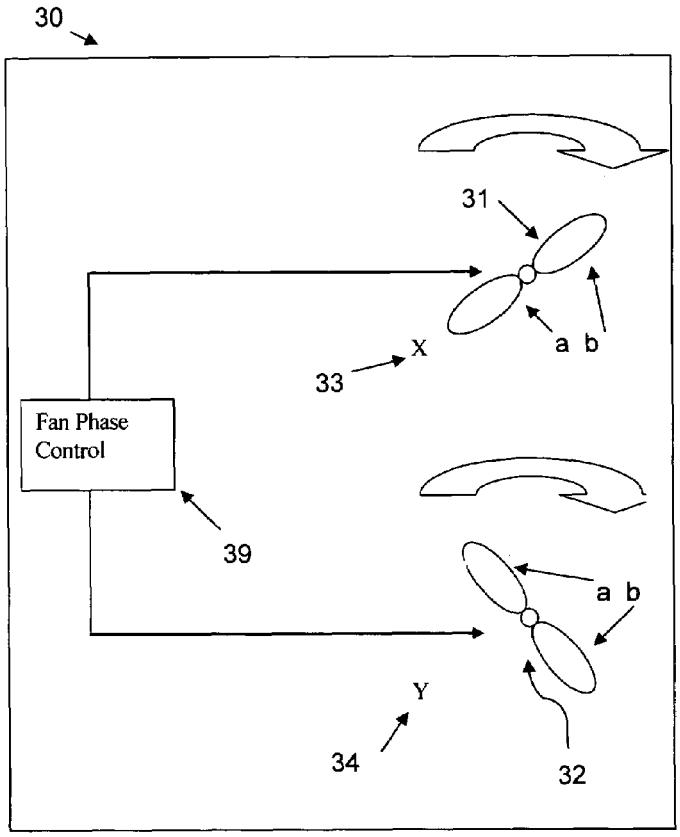
FIG. 3*a* is a schematic drawing illustrating a two-fan apparatus with a phase controller and FIG. 3*b* is a schematic drawing illustrating destructive interference of pressure waves from the apparatus of FIG. 3*b;*
Figure 3B:
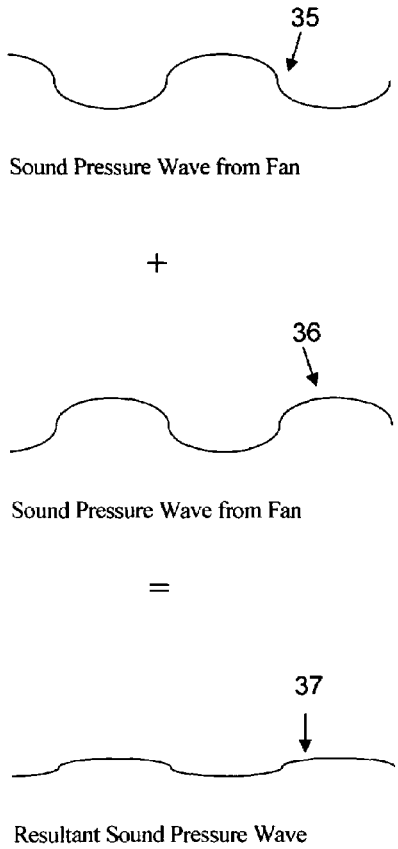

Referring to FIGS. 3*a* and 3*b* in combination, destructive interference of sound pressure waves is illustrated. The destructive interference is caused by controlled fan rotation phase of two fans 31 and 32 connected to a phase controller 39. As with the fans 21 and 22 illustrated in FIG. 2, the exemplary fans 31 and 32 of the fan apparatus 30 of FIG. 3*a* are two-blade fans rotating clockwise. If the different times, when the fan blades 31*a*, band 32*a, b* pass points X 33 and Y 34 are carefully controlled by phase controller 39, then the resulting acoustic waves 35 and 36 will similarly be out of phase. Thus, the acoustic waves 35 and 36 will interfere destructively, according to the principle of wave superposition, and produce an acoustic wave 37 with a reduced resultant noise.

Figure 4:
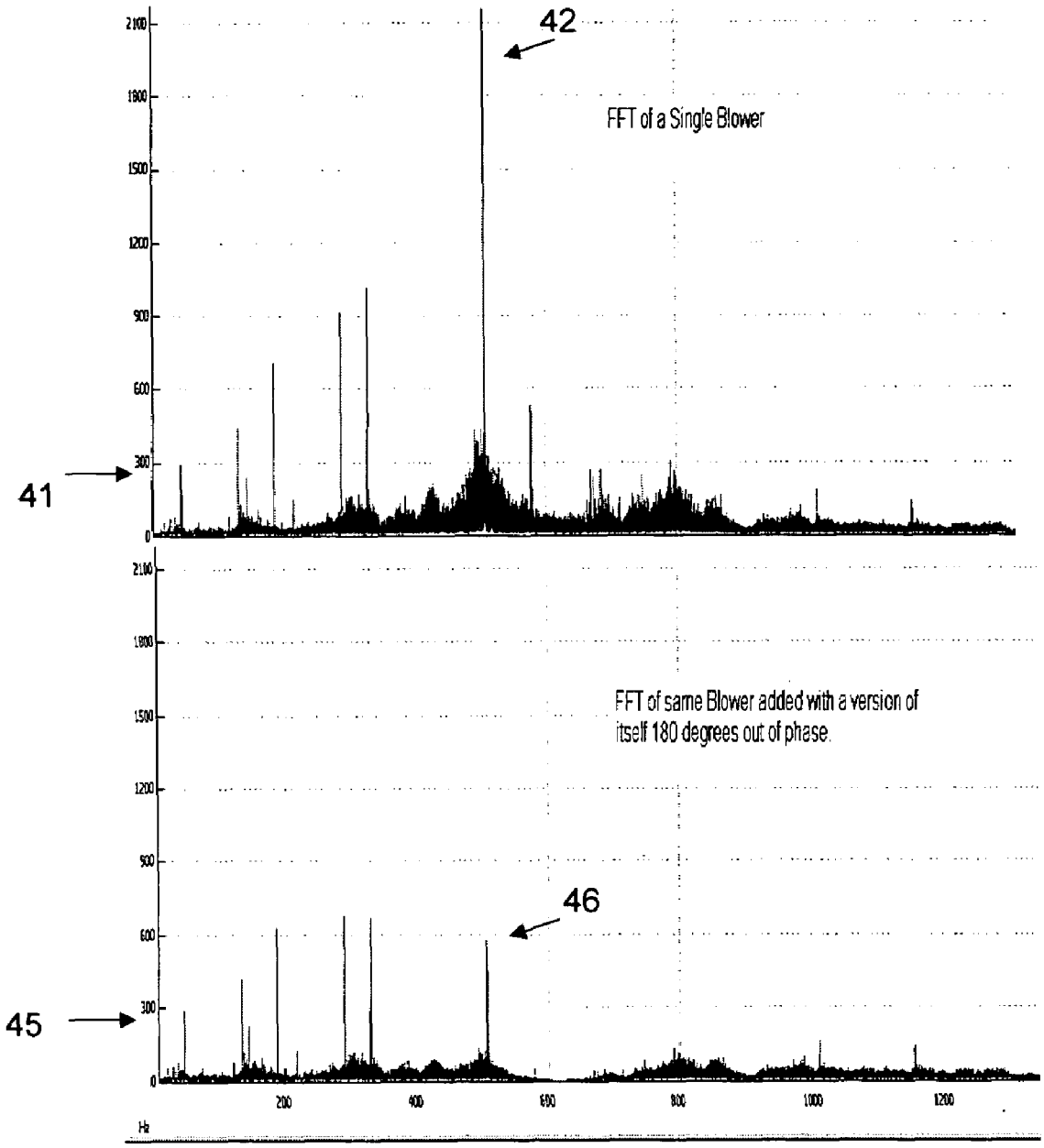
FIG. 4 is a schematic graph illustrating two Fourier transforms of the sound signal from an exemplary fan.

Referring to FIG. 4, Fourier transforms of the sound signal from an exemplary fan are illustrated. The top graph 41 in the figure shows the original sound signal's intensity as a function of frequency. The highest peak 42 in the graph corresponds to the blade passing frequency, which occurs at a frequency tone of about 500 Hz in this example. The lower graph 45 shows the superposition (i.e., destructive interference) at peak 46 of the exact same sound from that same fan being played back over the original sound but shifted in time by one-half of a 500 Hz wavelength (i.e., 180 degrees out of phase). This shifting by one-half of a wavelength corresponds to adjusting the phase of one fan blade relative to another by that amount. As the lower graph 45 indicates at peak 46, this technique significantly lowers the amount of 500 Hz BFP sound, rendering it practically inaudible.

The present invention can produce a specified pressure wave cancellation phase difference for a given acoustic tone (e.g., 500 Hz tone) without the use of costly and space consuming speakers, microphones, and a feedback circuit. One way is to misaligned the spatial coherence of the sound sources. For example, one fan or blower can physically be moved a calculated distance away from the other fan or blower, namely half a wave length (e.g., half of a 500 Hz wave length). Assuming the timing of the two fans is exactly synchronous, the two 500 Hz waves will annihilate each other. However, in most computer systems with multiple fans, the fans are set at a fixed distance apart determined by mechanical and packaging considerations. So adjusting the space between fans becomes difficult.

Another way to produce an exactly out of phase pressure wave is by controlling the temporal coherence of the sound sources. For example, the relative frequency and phase of rotation of the fans can be controlled so that destructive interference will occur. Noise cancellation can be achieved by using the anti-noise of one fan to cancel the noise of another, if fans are run at the same rotational speed and then set at an optimal phase of rotation difference.

There are many factors and imperfections which make multi-fan systems difficult systems to precisely control. As stated above, before phase control may occur the fan rotation speeds (fan rotation frequencies) must be exactly synchronized. The first and perhaps most difficult problem with synchronizing multiple fans is the inherent fan latency. For example, with the large fans or blowers used in modern-day computer equipment, there is a large amount of momentum with the spinning fan blade. Due to this momentum, even slight changes in the speed of rotation of one particular fan, such as, changes made in order to synchronize the speed of rotation of one fan to another fan, may require a significant delay in the time the new speed can be achieved. Even when this new speed is achieved, there will often be an error caused by the momentum and imperfections of the fan that results in under or over adjusting. Also, if the desired speed one is trying to lock onto is constantly oscillating, such as, oscillating caused by over or under adjusting or by synchronizing the speed of one fan to match the speed of another, the problem of fan synchronization becomes extremely difficult. Another obstacle to overcome in order to achieve the necessary level of control for noise cancellation is imprecise voltage response. A constant voltage input to the fans results in an inconsistent fan speed. The fan speeds will oscillate around the desired speed, but never exactly reach the desired speed indicated by the voltage input, no matter how long the system runs. Again, without fan speed synchronization, phase control becomes difficult.

Figure 5:
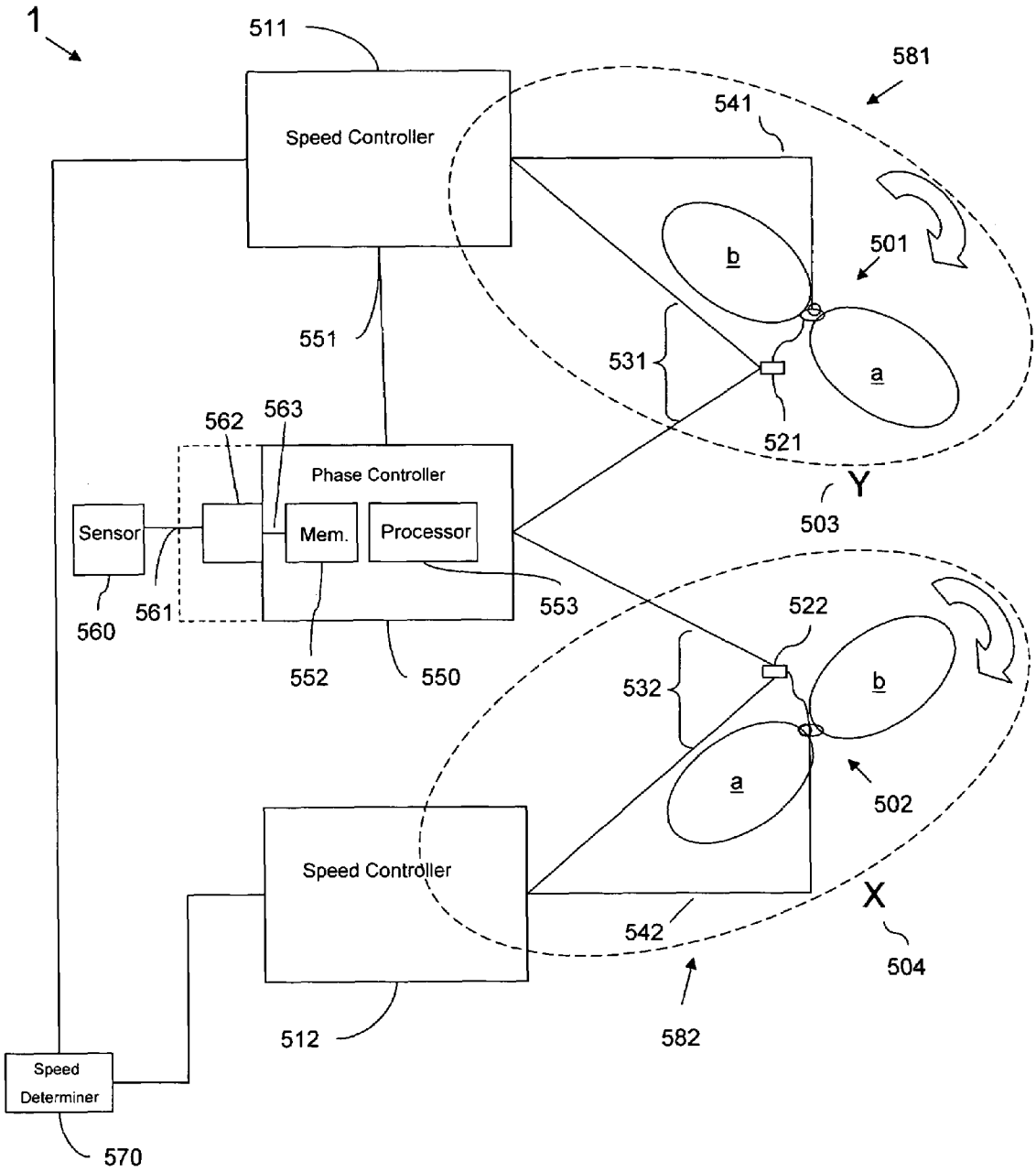
FIG. 5 is a schematic drawing illustrating one embodiment of the present invention.
Figure 7:
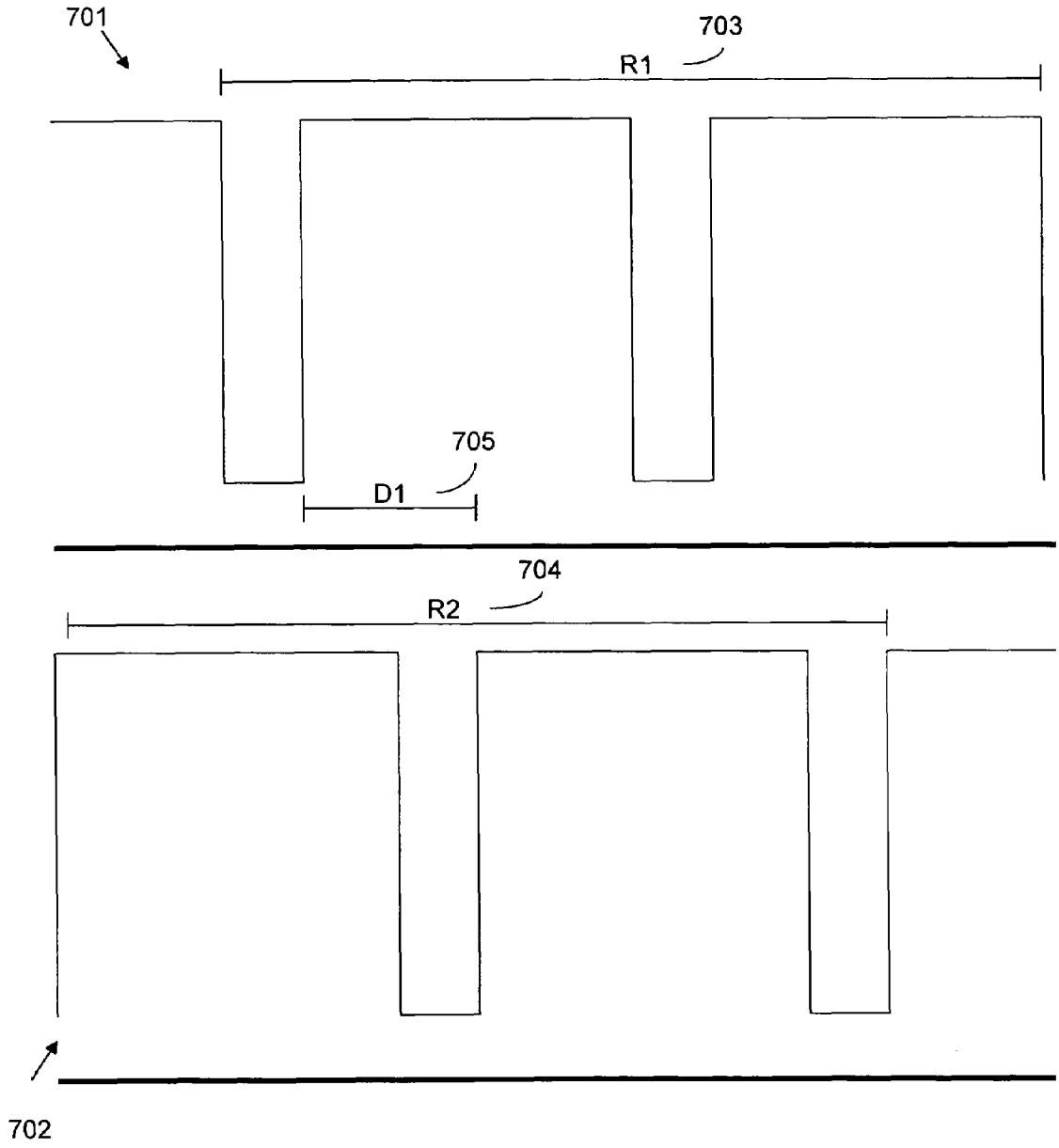
FIG. 7 is a schematic graph illustrating exemplary tachometer signals.

The multi-fan apparatus 1, illustrated in FIG. 5, comprises multiple fan circuits (e.g., first and second fan circuits, 581 and 582, respectively). Each fan circuit 581, 582 is adapted to establish a fan speed control loop and comprises a fan 501, 502, a tachometer 521, 522 and a fan speed controller 511, 512. The tachometers 521, 522 are adapted to detect a fan's phase of rotation and signal that information via tachometer signals 531, 532. FIG. 7, discussed below, illustrates the tachometer signals in further detail. Each fan speed controller 511, 512 can be adapted to determine a fan's speed based upon phase of rotation information by timing successive tachometer signal transitions. The fan speed controllers can further be adapted to independently and dynamically maintain the fan at a set speed. A fan speed determiner 570 connected to each of the fan speed controllers 511, 512 can input a same set fan speed to each of the fan speed controllers, such that the fans may be synchronized to the same speed. The multi-fan apparatus 1 further comprises a fan phase controller 550 that is connected to at least one of the fan speed controllers (e.g., 511) and to each tachometer 521, 522. The fan phase controller 550 can be adapted to separate the phases of rotation between fans 501, 502 to establish a cancellation phase of rotation difference which serves to reduce at least one of noise and vibrations emanating from the fan apparatus 1.

In addition, the fan phase controller 550 can comprise a processing device 553 and a memory device 552. The processing device 553 can be adapted to read fan phase of rotation signals 531, 532 emanating from the tachometers 521, 522. The processing device 553 can be adapted to determine fan speeds and a current phase of rotation difference between the fans. The processing device can further be adapted to compare the cancellation phase difference with the current phase difference. The processing device 553 can also be adapted to calculate a short term fan speed variation that at least one of the fans at least one of the fans can be subjected to in order to separate the rotation phases of the fans to the cancellation phase difference. Once the short term fan speed variation calculated, the controller 550 can signal the speed variation (551) to a fan speed controller 511. The memory device 552 can store the cancellation phase difference value. The cancellation phase difference value can be pre-determined and stored in the memory device 552. The cancellation phase difference can also be dynamically determined by a cancellation phase difference determiner 562 based upon feedback signals 561 containing measurements from sound and/or vibration sensors 560 and then stored in the memory device 552.

Figure 6:
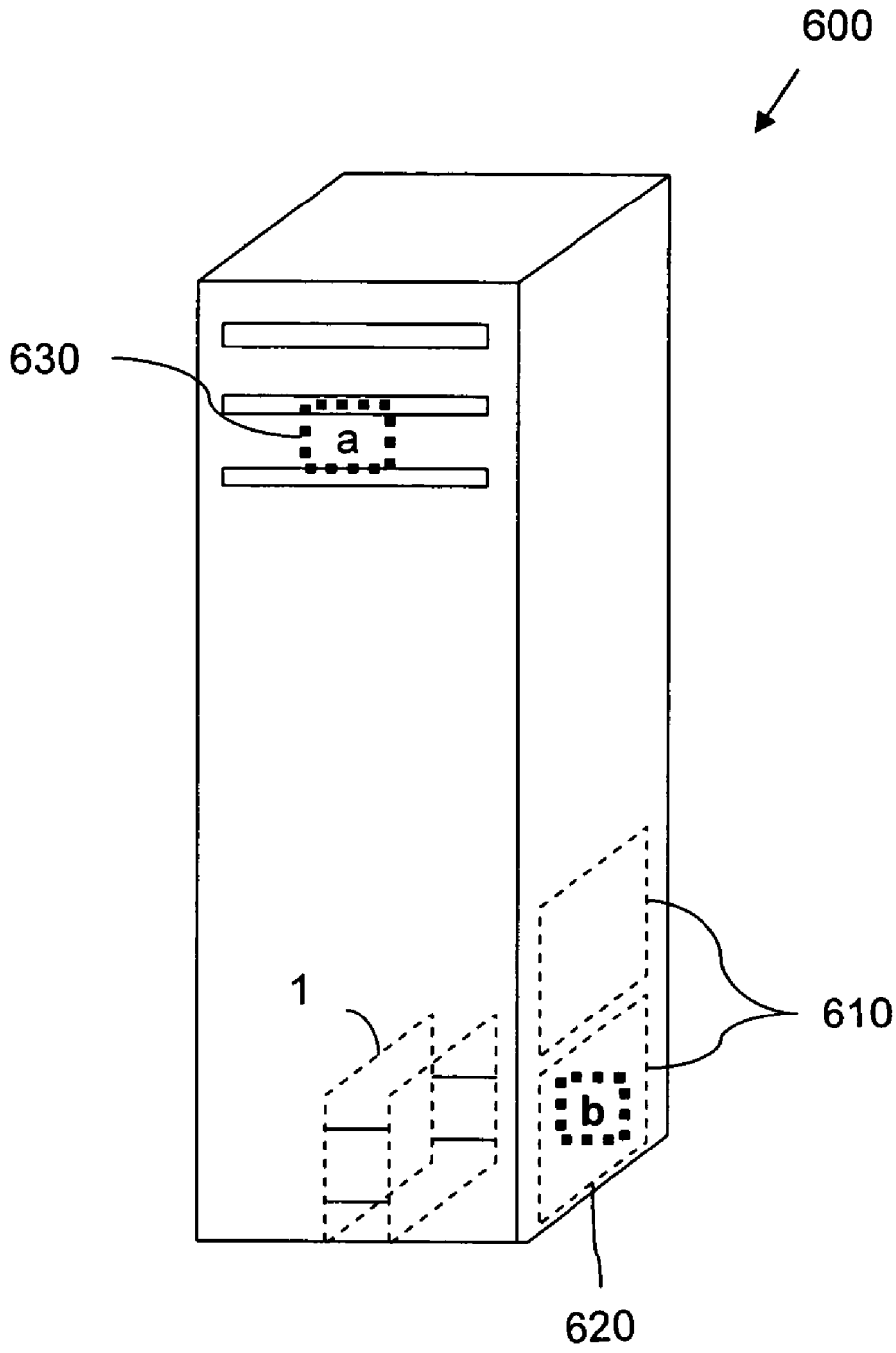
FIG. 6 is a schematic perspective drawing illustrating an exemplary system incorporating the multi-fan apparatus of the present invention.

Referring to FIG. 6, a cancellation phase difference required to reduce noise and/or vibration in a given localized region (e.g., region a, 630 or region b, 620), not limited to a fan duct outlet, of a system (e.g., computer processing unit 600) incorporating the fan apparatus 1 of the present invention can be determined. In operation, the apparatus of the present invention thus allows a user or manufacturer to determine an optimal cancellation phase difference so as to cancel BFP noises in the front of the computer. Similarly, the user or manufacturer may determine an optimal cancellation phase to cancel vibration at a different location (e.g., disk drives). As stated above, this cancellation phase difference can be pre-calculated or dynamically determined. The value of this cancellation phase difference can also be variable depending upon multiple factors, including but not limited to, the following: the physical arrangement of the fans (e.g., side by side, in-line, etc.) and location of the fan apparatus within the system 600; within the system 600, the location of the localized region 620, 630, where the cancellation is desired, relative to the location of the fan apparatus 1; the speed of propagation of the pressure waves; the relative spacing between fan outlets 610 in the system 600; and, the number of fan blades on each fan.

More particularly, an embodiment of the multi-fan apparatus 1 of the present invention, illustrated in FIG. 5, comprises two fans 501 and 502 rotating in a clockwise direction. The phase of rotation of each fan 501, 502 is measured by its own tachometer 521, 522, respectively. Fan speed synchronization can be accomplished by controlling the speed of each fan by an independent fan speed control loop established by fan circuit 581, 582. Each fan 501, 502 within a fan circuit 581, 582 is dynamically adjusted to a same set speed by its own fan speed controller 511, 512. The fan speed controller determines fan speed based upon feedback from its corresponding tachometer 521, 522 and adjusts the fan speed to the set speed. Specifically, each fan speed controller 511, 512 reads and averages the tachometer signal 531, 532 to determine fan speed and dynamically adjusts the speed of its fan 501, 502, accordingly.

A tachometer signal 531, 532 can be a square wave providing phase of rotation information. Specifically, referring to FIG. 7, square waves 701 and 702 illustrate the tachometer signals 531 and 532 of fan circuits 581 and 582, respectively. The signal may measured by the controllers in rotations per minute to determine fan speed. R1 (703) and R2 (704) reference one rotation of the fan. The rising edges indicate that the blades of the measured fan are in a precise and known position. Thus, by measuring the frequency of the tachometer signal, comparing it to a desired reference frequency and either increasing or decreasing the fan's speed, that fan's speed may be precisely controlled. A fan's speed is typically electronically controlled either by an analog voltage level, or by the width of a pulse-width-modulated signal.

Each fan circuit 581, 582 provides for the independent and dynamic adjustment of fan speed using an independent control loop. For example, the independent control loop may be established by using a generalized state-space integral controller with full observer. The independent control loops are specifically designed to eliminate the need for continuous operator attention and adjustment. In addition, the independent control loops synchronize each fan to the same set speed by eliminating the added variable of trying to continually adjust one fan to another whose speed might be oscillating. The controllers are adapted to compensate for the long response time latency of large blowers as discussed above.

Referring in combination to FIGS. 5 and 7, once the fans are synchronized (i.e., running at the same frequency or speed), a Fan Phase Controller 550 connected to at least one of the fan speed controllers 511 receives the tachometer signals 701, 702 from each tachometer. The fan phase controller is adapted to measure the time difference between the rising edges of the tachometer signals emanating from the two fans. D1 705 references this measurement. Time D1 705 precisely indicates the amount of delay between the time at which the blade of one fan 501*a* passes a given point X 503 and the blade of the other fan 502*a* passes an equivalent point Y 504. The desired time delay between the blades 501*a*, 502*a* that causes destructive interference of the sound waves emanating from the fan blades 501*a-b*, 502*a-b*, as discussed above, can be pre-calculated based upon a number of factors (e.g., the physical arrangement of the fans, the distance between the area where noise cancellation is desired and the fans, the speed of propagation of the sound or vibration pressure waves, the relative spacing of fan outlets, the number of fan blades on each fan, etc.) with or without feedback from sound and/or vibration sensors. The pre-calculated cancellation phase difference is then stored in a memory device 552 of the phase controller 550 and used to establish a phase control loop. This cancellation phase difference may be periodically recalculated and again stored into the phase controller memory 552.

Alternatively, the cancellation phase difference may be dynamically calculated by a cancellation phase determiner 562. In order to dynamically calculate the cancellation phase difference mechanisms must be in place to take online measurements of the physical parameter to be minimized. Specifically, within a system incorporating the multi-fan apparatus 1, sound and/or vibration sensors 560 (e.g., microphone, piezoelectric accelerometer, etc.) take measurements in the localized region (e.g., regions 620, 630 of FIG. 6) where noise and/or vibration cancellation is desired. Theses sensors 560 are in communication 561 with the cancellation phase determiner 562. The cancellation phase determiner 562 may or may not be a structure within the phase controller 550. The cancellation phase determiner 562 is adapted to dynamically calculate an optimal cancellation phase based upon signals 561 from the sensor(s) 560. For example, if BFP sound is to be minimized, then a microphone can be used to measure that sound, and the cancellation phase difference can be determined and the phase of rotation adjusted by the controller 550 accordingly. Cancellation phase difference adjustments will continue until the sensor signals 561 indicate that the blade passing frequency sound has been minimized. If physical vibration is to be minimized, then a vibration sensor like (i.e. a piezoelectric accelerometer) can be used to measure vibration and the cancellation phase determiner 562 will adjust the phase difference until the sensor 560 indicates that the vibration at the blade passing frequency has been minimized.

Figure 8:
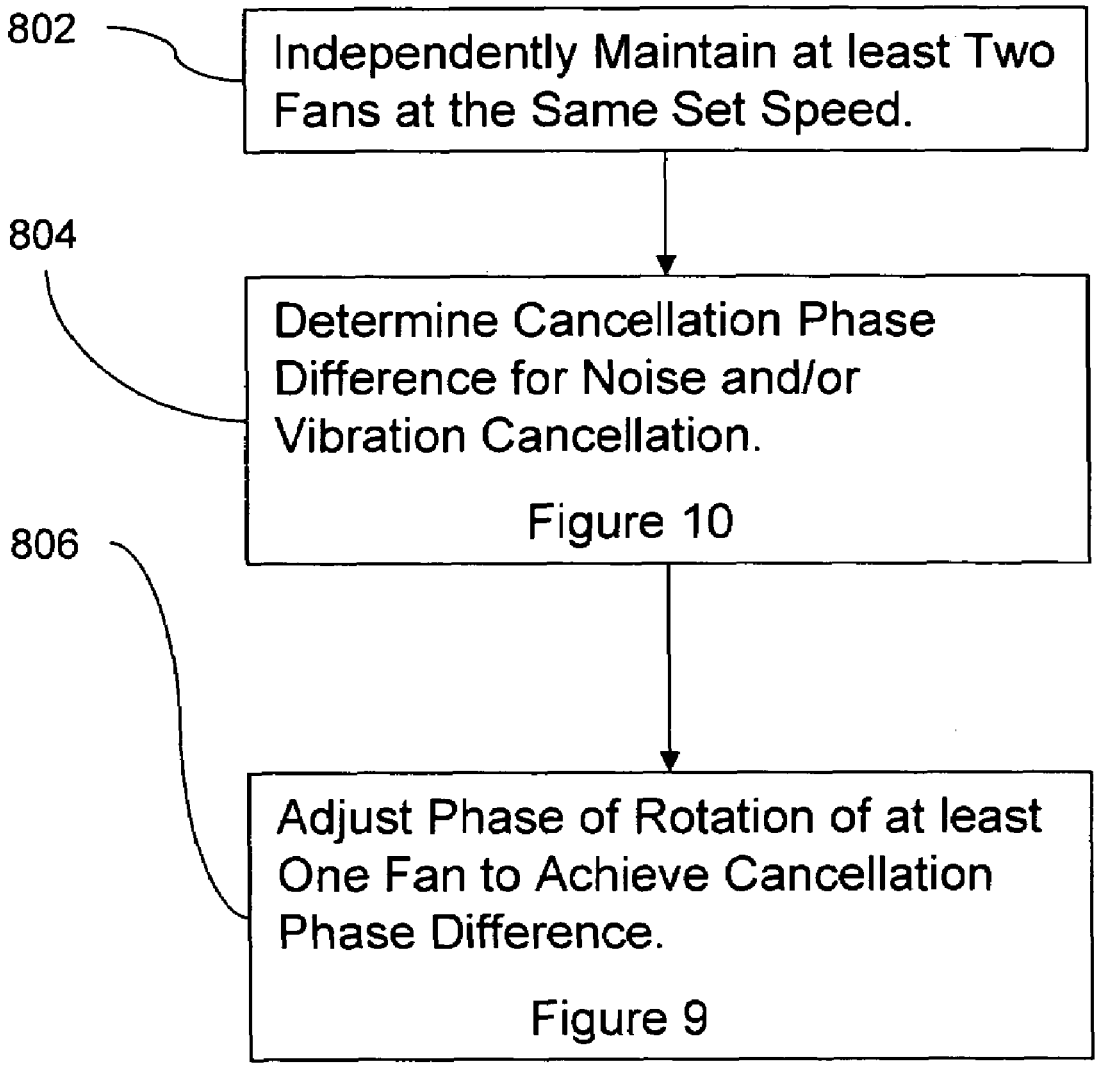
FIG. 8 is a schematic flow diagram illustrating one embodiment of the method of the present invention.

Referring to FIG. 8, another embodiment of the present invention is a fan noise and vibration cancellation method. According to the fan noise and vibration cancellation method, a cancellation phase difference between at least two fans to provide noise and/or vibration cancellation is determined 804. The fans are independently maintained at the same set speed 802. Once the same set speed is established, the phase of rotation of at least one of the fans is adjusted relative to another of the fans to establish and maintain the cancellation phase difference 806. The cancellation phase difference between fans in a system is determined so as to cause destructive interference to sound and/or vibration pressure waves in a localized region, where the cancellation is desired.

Figure 9:
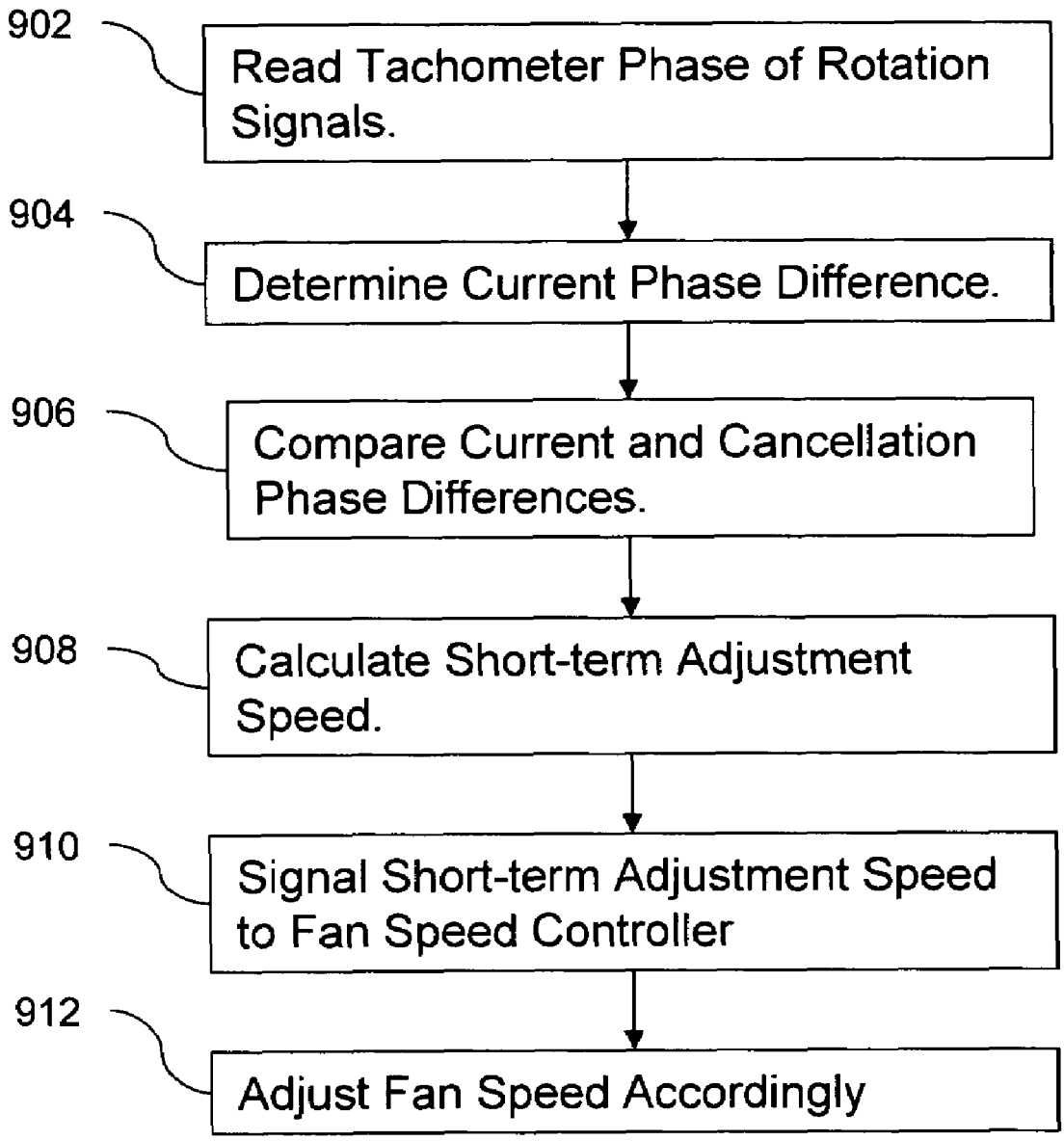
FIG. 9 is a schematic flow diagram illustrating method step 806 of FIG. 8; and, FIG. 10 is a schematic flow diagram illustrating method step 804 of FIG. 8.
Figure 10:
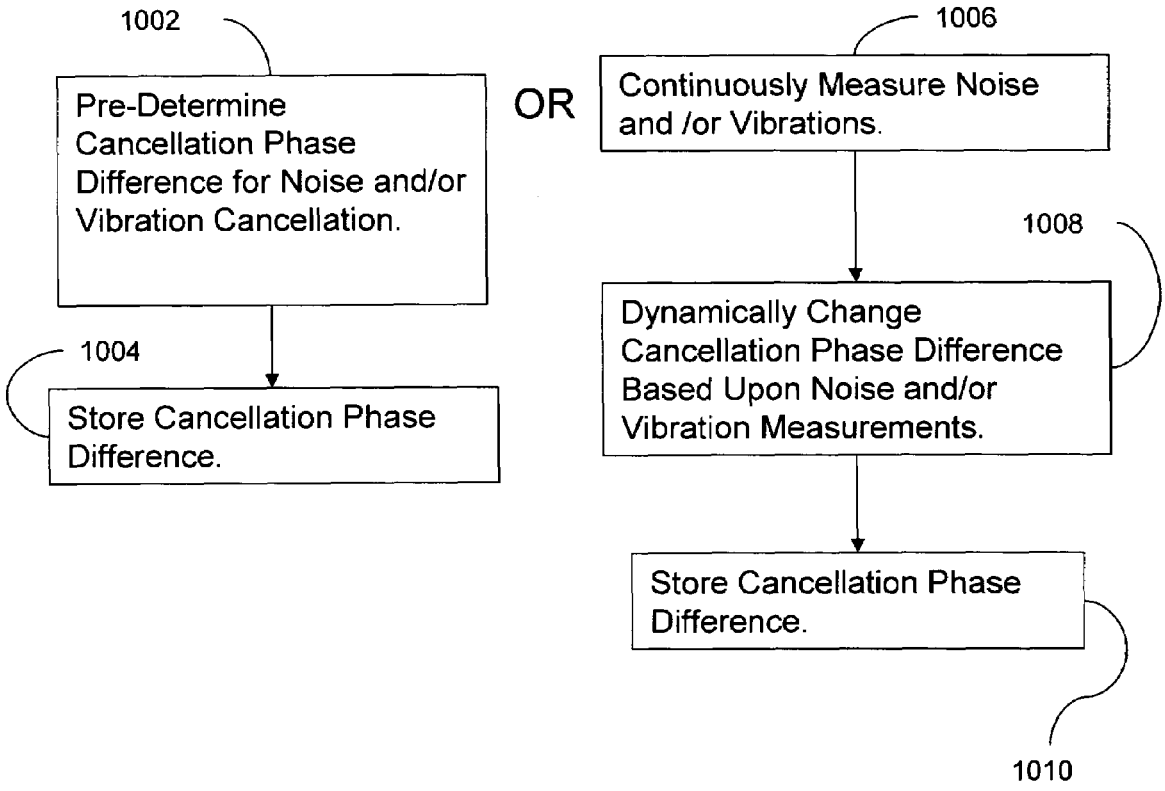

Referring to FIG. 10, the cancellation phase difference of method step 804 may be determined in a variety of ways. The cancellation phase difference may be static, such that it is pre-determined 1002 and stored into memory 1004. Alternatively, the cancellation phase difference may be dynamically determined. For example, the stored cancellation phase difference values 1010 may be dynamically changed 1008 based upon continuous readings from sound and/or vibration sensor measurements 1006 taken in a localized region, where the cancellation is required. Referring to FIG. 9, in order to adjust the phase of rotation of at least one of the fans relative to the phase of rotation of another (method step 806), the fan phase of rotation signals emanating from the tachometers connected to each of the fans are read 902 and used to determine fan speeds and a current phase of rotation difference between the fans 904. The current phase difference is compared to the cancellation phase difference 906. Then, a short term fan speed variation (fan adjustment speed) which would be required for at least one of the fans in order to separate the phases of rotation between the fans to establish the cancellation phase difference is calculated 908. The short term fan speed variation is then signaled to a fan speed controller 910 and the fan speed controller adjusts the speed of the fan accordingly 912.

The principle of destructive interference of pressure waves as illustrated in FIG. 1, applies to two or more waves. Therefore, those skilled in the art will recognize that even though the exemplary embodiments of the fan apparatus (FIGS. 5-7) and method (FIGS. 8-10) of the present invention illustrate two-fan apparatuses, the apparatus and method may incorporate more than two fans.

The present invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the present invention. The examples used herein are intended merely to facilitate an understanding of ways in which the invention may be practiced and to further enable those of skill in the art to practice the invention. Accordingly, the examples should not be construed as limiting the scope of the invention.

Thus, a fan apparatus which incorporates the present invention will allow more powerful computers having more powerful blowers to be deployed into an environment from which they have hitherto been prohibited. For a given cooling requirement, the system can be made quieter and thus sold into environments and markets that were previously unavailable. Alternatively, computer systems employing the fan apparatus of the present invention can be run faster at the same noise level, allowing the cooling of hotter electronics than otherwise. Unlike traditional active noise cancellation techniques, the present invention requires almost no additional equipment. Thus, the present invention incurs almost no additional system cost.

While the invention has been described in terms of preferred embodiments, those skilled in the art will recognize that the invention can be practiced with modification within the spirit and scope of the appended claims.

What is claimed is:

1. A multi-fan apparatus comprising:

a first fan circuit comprising:

a first fan;

a first tachometer connected to said first fan; and, a first fan speed controller connected to said first fan;

a second fan circuit comprising;

a second fan;

a second tachometer connected to said second fan; and, a second fan speed controller connected to said second fan; and, a fan phase controller connected to said first fan speed controller and each of said tachometers, wherein said fan phase controller separates phases of rotation of said first fan and said second fan; and, wherein said first fan circuit and said second fan circuit operate independently.

2. The apparatus according to claim 1, further comprising a fan speed determiner connected to each of said fan speed controllers for inputting a same set fan speed to each of said fan speed controllers.

3. The apparatus according to claim 1, wherein said tachometers are adapted to detect and signal fan phase of rotation information.

4. The apparatus according to claim 1, wherein said fan phase controller is adapted to separate phases of rotation of said first fan and said second fan to establish a cancellation phase of rotation difference for providing at least one of noise cancellation and vibration cancellation.

5. The apparatus according to claim 4, wherein said fan phase controller comprises a processing device, and wherein said processing device is adapted to determine fan speeds and to determine a current phase of rotation difference between said first fan and said second fan, based upon phase of rotation signals emanating from each of said tachometers;

wherein said processing device is further adapted to compare said cancellation phase difference with said current phase difference and to calculate a short term fan speed variation for at least one of said fans to separate said phases of rotation of said first fan and second fan to said cancellation phase difference; and, wherein said fan phase controller is further adapted to signal said short term fan speed variation to said first fan speed controller.

6. The apparatus according to claim 4, wherein said fan phase controller further comprises a memory device.

7. The apparatus according to claim 6, wherein said cancellation phase difference may be pre-determined for any given location, where at least one of noise cancellation and vibration cancellation is desired, within a system incorporating said apparatus; and wherein said pre-determined cancellation phase difference is stored in said memory device.

8. The apparatus according to claim 6, further comprising a cancellation phase difference determiner connected to at least one of a sound sensor and a vibration sensor and to said fan phase controller; and wherein said cancellation phase difference determiner is adapted to dynamically determine said cancellation phase difference based upon measurements from said at least one of said sound sensor and said vibration sensor and to store said cancellation phase difference in said memory device.

9. The apparatus according to claim 4, wherein said cancellation phase difference is variable depending upon multiple factors, including but not limited to, the physical arrangement of said first fan and second fan within a system, the location of a region of said system where said cancellation is desired relative to the location of said fans, the speed of propagation of said pressure waves, the relative spacing between fan outlets in said system, and the number of fan blades on each fan.

10. A multi-fan apparatus comprising:

a first fan circuit comprising:

a first fan;

a first tachometer connected to said first fan; and a first fan speed controller connected to said first fan;

a second fan circuit comprising:

a second fan;

a second tachometer connected to said second fan; and a second fan speed controller connected to said second fan;

a fan speed determiner connected each of said fan speed controllers adapted to input a same set fan speed to each of said fan speed controllers; and a fan phase controller connected to said first fan speed controller and each of said tachometers, wherein said fan phase controller is adapted to separate phases of rotation of said first fan and said second fan to establish a cancellation phase of rotation difference for providing at least one of noise and vibration cancellation;

wherein said first fan circuit and said second fan circuit operate independently.

11. The apparatus according to claim 10, wherein said tachometers are adapted to detect and signal fan speed and phase of rotation.

12. The apparatus according to claim 11, wherein said fan phase controller comprises a processing device, and wherein said processing device is adapted to read said fan phase of rotation signals emanating from each of said tachometers and to determine fan speeds and a current phase of rotation difference between said first fan and said second fan;

wherein said processing device is further adapted to compare said cancellation phase difference with said current phase difference, and calculate a short term fan speed variation for at least one of said fans to separate said phases of rotation of said first fan and second fan to said cancellation phase difference; and wherein said fan phase controller is further adapted to signal said short term fan speed variation to said first fan speed controller.

13. The apparatus according to claim 10, wherein said fan phase controller further comprises a memory device.

14. The apparatus according to claim 13, wherein said cancellation phase difference may be pre-determined for any given location, where at least one of noise cancellation and vibration cancellation is desired, within a system incorporating said apparatus; and wherein said pre-determined cancellation phase difference is stored in said memory device.

15. The apparatus according to claim 13, further comprising a cancellation phase difference determiner connected to at least one of a sound sensor and a vibration sensors and to said fan phase controller; and wherein said cancellation phase difference determiner is adapted to dynamically determine said cancellation phase difference based upon measurements from said at least one sensor and to store said cancellation phase difference in said memory device.

16. The apparatus according to claim 10, wherein said cancellation phase difference is variable depending upon multiple factors, including but not limited to, the physical arrangement of said first fan and second fan within a system, the location of a region of said system where said cancellation is desired relative to the location of said fans, the speed of propagation of said pressure waves, the relative spacing between fan outlets in said system, and the number of fan blades on each fan.

* * * * *